US005406944A

United States Patent [19]

Gazzara

[11] Patent Number: 5,406,944

[45] Date of Patent: Apr. 18, 1995

[54] MASK WITH ADJUSTABLE SHIELD

[75] Inventor: Peter J. Gazzara, Reading, Mass.

[73] Assignee: Splash Shield Limited Partnership, Woburn, Mass.

[21] Appl. No.: 91,971

[22] Filed: Jul. 13, 1993

[51] Int. Cl.[6] ..... A62B 7/10; A62B 18/02

[52] U.S. Cl. ..... 128/206.19; 128/201.12; 128/857

[58] Field of Search ..... 128/206.17, 206.16, 128/206.12, 201.17, 201.24, 863, 857, 201.14, 201.15, 206.23

[56] References Cited

U.S. PATENT DOCUMENTS

| | | | |
|---|---|---|---|
| 4,419,993 | 12/1983 | Petersen | 128/206.19 |
| 4,796,621 | 1/1989 | Barle et al. . | |
| 4,797,956 | 1/1989 | Boyce | 128/206.19 |
| 4,843,643 | 7/1989 | Parissenti et al. | 128/857 |
| 4,920,960 | 5/1990 | Hubbard et al. | 128/206.19 |
| 4,944,294 | 7/1990 | Borek, Jr. | 128/201.15 |
| 4,945,574 | 8/1990 | Dagher | 128/863 |
| 5,020,533 | 6/1991 | Hubbard et al. . | |
| 5,067,174 | 11/1991 | Ritchey et al. . | |
| 5,113,528 | 5/1992 | Burke, Jr. et al. . | |

FOREIGN PATENT DOCUMENTS

WO89/10106 11/1989 WIPO .

*Primary Examiner*—Edgar S. Burr
*Assistant Examiner*—William J. Deane, Jr.
*Attorney, Agent, or Firm*—Choate, Hall & Stewart

[57] ABSTRACT

A face protector that includes a face mask and a transparent member, the transparent member can be adjustably positioned relative to the face of the wearer. The face mask includes fasteners for securing the mask to the face of the wearer, and the transparent member is affixed to the face mask by a structure that allows the transparent member to be positioned at a plurality of distances from the mask.

12 Claims, 2 Drawing Sheets

MASK WITH ADJUSTABLE SHIELD

BACKGROUND OF THE INVENTION

This invention relates in general to medical equipment, and in particular to face shields and face masks that are worn by medical personnel.

Medical personnel have long used face masks to protect their patients from contamination during sterile procedures and other treatments, for example by airborne bacteria. Medical personnel also wear face masks to protect themselves from contracting diseases from the patients that they treat, for example due to exposure to contaminated fluids or other contaminated material. As the understanding of disease transmission has increased, so has the need for effective protection of medical personnel from inadvertent contraction of disease by contamination. Towards this end several full face-shield and combined eye-shield/face-mask devices have been created. Each of these devices has a fixed distance at which the eye shield is set away from the face; however, an individual user may prefer to be able to adjust the distance of the eye shield from their own face.

SUMMARY OF THE INVENTION

The face protector of the invention is a face mask to which a transparent member is attached by a structure that allows the distance of the transparent member from the face of the wearer to be adjusted. The face mask is provided with fasteners for securing the face protector to the face of a wearer. The transparent member is secured to the face mask by the adjustment structure, and no further fasteners for securing the transparent member to the wearer are required. The adjustment structure is affixed to both the face mask and the transparent member, providing a link between the two face coverings, and a means by which the distance between the transparent member and the wearer's face can be adjusted to suit the particular wearer. Suitable material for the adjustment structure include malleable metals, foam, cardboard, resilient plastics, and the like which can provide support for the transparent member, and can be manipulated such that the transparent member can be moved closer to or away from the face of the wearer while not impinging upon the secure fit of the face mask. The adjustment structure is preferably attached to the upper edges of the face mask and to a lower portion of the transparent member. The adjustment means for adjusting the distance of the transparent member from the wearer's face can also include a means by which the curvature of the transparent member can be adjusted.

DETAILED DESCRIPTION OF THE INVENTION

Figure 1:
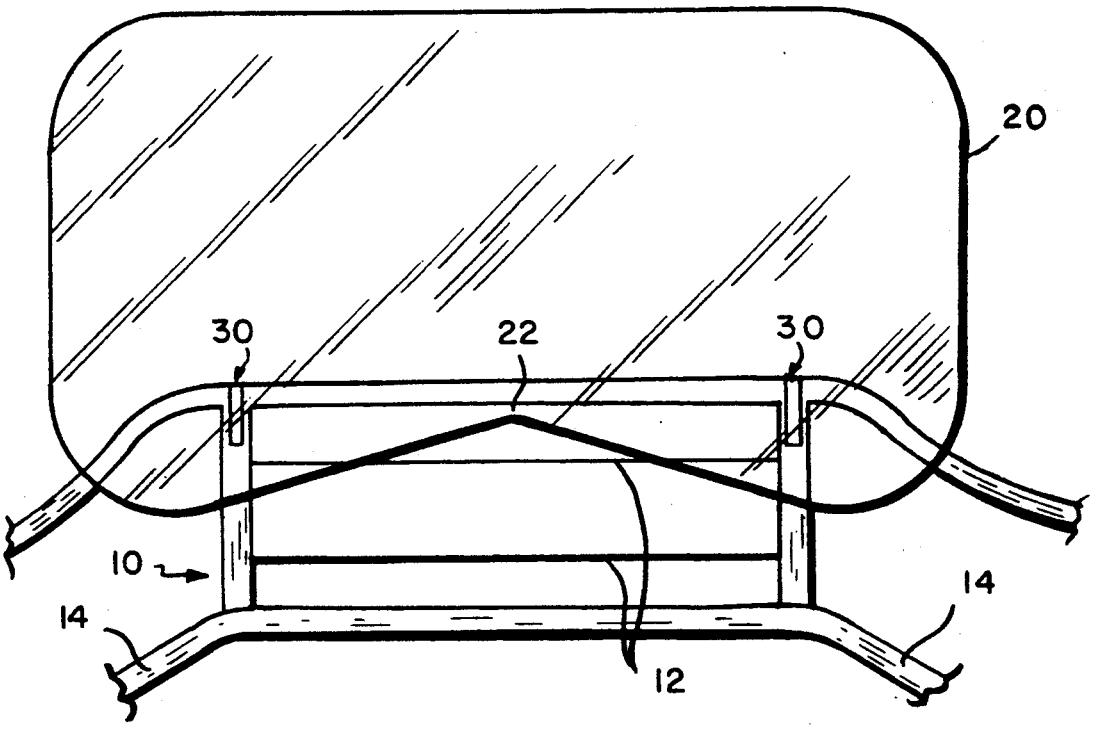
FIG. 1 is a planar view of a preferred embodiment of the face protector of the invention.
Figure 2:
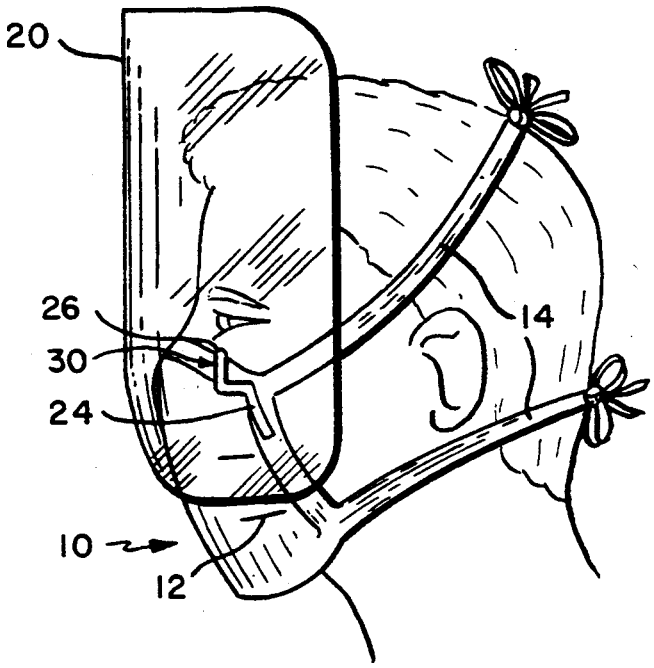
FIG. 2 is a perspective view of one embodiment of the face protector of the invention disposed upon the face of a wearer.
Figure 3:
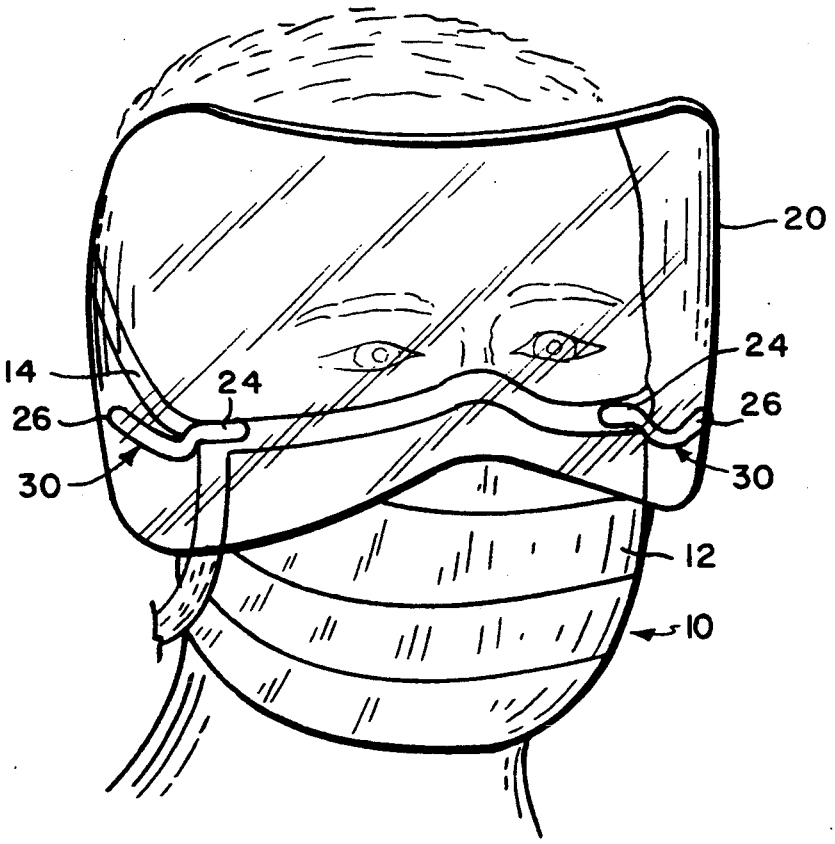
FIG. 3 is a perspective view of another embodiment of the face protector of the invention disposed upon the face of a wearer.

With reference now to FIGS. 1, 2 and 3, a face protector is composed of, a mask 10, such as are commonly used by medical personnel today, which is provided with a transparent member 20 that is adjustably affixed to the mask 10 by a structure 30 which allows the transparent member 20 to be positioned at a plurality of distances from the mask 10. The mask 10 includes pleats 12 and is provided with fasteners 14 for securing the mask to the face of the wearer. The mask 10 is secured to the transparent member 20 by at least one adjustment structure 30. A first portion 24 of the adjustment structure 30 is affixed to the mask 10 and a second portion 26 of the adjustment structure 30 is affixed to the transparent member 20. By grasping the transparent member 20 the wearer can adjust the distance of the transparent member from their face, as will be described more fully below.

A detailed description of each element of the face protector of the invention is provided below with references to both FIG. 1 and FIG. 2 as appropriate.

The mask 10 used should be a disposable, fluid resistant face mask that is sized to cover the nose and mouth of a wearer and to extend beneath the wearer's chin. Any of the widely available face masks having multiple layers of material that are designed specifically to preclude fluids and microorganisms from reaching the face of the wearer would be suitable for use. The face mask should be pleated with one or more pleats 12 such that there is sufficient room for the nose and mouth of the wearer during use. The pleats also increase the comfort of the wearer when the mask is worn for long periods of time. The face mask should have fasteners 14, such as ties attached to each corner for securing the mask to the head of the wearer by tying the ties behind the wearer's head, or should include looped fasteners which allow securing of the mask to the face of the wearer by placing the loops over the ears of the wearer. The face mask can also include a semi-rigid member for use as a nose conforming bar as is well known in the art. The nose conforming bar is disposed at the top edge of the mask and is made of a malleable metal such as aluminum. The nose conforming bar allows the wearer to fit the mask more closely to the bridge of their nose, such that gaping of the face mask is prevented.

The transparent member 20 is preferably an optically clear plastic film, such as polyester or polycarbonate. The transparent member is preferably treated with an anti-fog coating and is scratch resistant. The transparent member is dimensioned to span the width of a wearer's face and to extend from a point below the wearer's nose to a point above the wearer's eyes. The transparent member can be the size of a standard eye shield in that it would cover predominantly the eyes of the wearer, or the transparent member can be as large as a full face mask that covers from the top of the wearer's forehead to beneath the wearer's chin. The transparent member can also be made wide enough that it covers the wearer's cheeks, and may also cover the wearer's ears. The shape of the transparent member is so selected as to allow the smooth curving of the transparent member in front the wearer's face without creasing or greatly deforming the transparent member. For example, as shown in FIG. 1, the transparent member which is sized to cover the upper half of the wearer's face can include a cut-out or shaped portion 22. The shaped portion is positioned over the nose of the wearer so that the nose of the wearer does not interfere with the fit of the transparent member when the transparent member is brought close to the wearer's face, and so that the transparent member will not rest upon the wearer's nose which may cause discomfort when the face protector is worn for long periods of time.

Glare or reflections from lights onto the transparent member can be reduced by including a dark strip of matte material on the top edge of the face mask, as is known in the art. The dark strip on the face mask functions to reduce the glare by not reflecting light rays from the face mask onto the transparent member.

The structure 30 for adjusting the distance between the transparent member and the mask can include metal, compressible foam, articulated cardboard and articulated plastics. The material chosen for use as the adjustment structure should be malleable such that it will deform under tension to a desired shape, and have sufficient rigidity that it will retain the desired shape and will fully support the transparent member. The material can have resilience, but should not have sufficient resilience to return itself to a previous position. It is preferable that material for the adjustment structure be chosen to allow the variable positioning of the transparent member to a plurality of distances from the wearer's face. It is also preferable that the adjustment structure allow the positioning of the transparent member to at least two inches away from the wearer's face. The adjustment structure is fixed to the mask and to the transparent member by welding, gluing, rivets or other suitable fixation means that are compatible with the material chosen for use as the adjustment structure.

A malleable metal is the preferred material for use as an adjustment structure, as it can also be used to impart a desired curvature to the transparent member as will be discussed below. The adjustment structure that is made of a maleable metal will be thin, up to a few millimeters thick, about 0.5 cm or more wide, and as long as is needed. Any metal that can be manipulated by finger pressure from the hands of a wearer, and is not brittle, in that it can be bent many times without breaking, is suitable for use. Useful maleable metals include aluminum, copper, steel, silver, etc. The preferred malleable metal is aluminum as it is inexpensive, easy to work with, and has the desired properties for the adjustment structure. Articulated cardboard and plastic products can also be used as the adjustment structure. An articulated material, as that term is used herein, means a resilient material having pleats or other means of compacting the length of the material and once compacted the material can be manipulated to expand this compacted form to a partial extent or a full extent of its length. For example, a piece of plastic having flanges at either end can be formed such that the length of the plastic is reduced by the inclusion of pleats. One flange on either end can be affixed to each of the mask and the transparent member. The face protector can be secured to the face of a wearer. and the transparent member can be moved away from the face of the wearer to the full extent of the length of the pleated plastic by pulling the transparent member and causing the pleats to expand. The resilient nature of the plastic will allow the transparent member to remain at this distance away from the face of the wearer.

The adjustment structure 30 can be affixed to the mask 10 at a point near the upper edge of the mask 10, as is shown in FIGS. 1–3, or an alternative location on the mask could be chosen. The adjustment structure 30 can be affixed to the transparent member 20 at a point in the lower region of the transparent member 20, as is shown in FIGS. 1–3, or can be fixed at an alternative location. The attachment site for the adjustment structure 30 to the transparent member 20 will depend upon the size of the transparent member chosen, as will be apparent to those of ordinary skill in the art. If the transparent member is chosen to be of the size of an eye shield, as is shown in FIGS. 1–3, then the adjustment structure could alternatively be affixed to a more central portion of the mask and of the transparent member.

With reference now to FIGS. 1–3, the preferred embodiment of the face protector will be described. An adjustment structure 30 that is a strip of malleable metal, such as aluminum, is shown affixed to the mask 10 and to the transparent member 20. When the adjustment structure is a strip of malleable metal, the malleable metal is provided with a configuration that allows the positioning of the transparent member at a plurality of distances from the mask without creating a stress on either the mask or the transparent member. Such a configuration includes an overlap of the ends of the strip of malleable metal when the transparent member is in the position closest to the mask. For example, when two attachment structures are used, the strip of malleable metal can be shaped in the any form that provides two attachment sites, and an length to be extended, such as is provided by shaping the malleable metal in the form of a Z, S, U, V , W, etc. In FIG. 2, an example of the malleable metal adjustment means is shown in which the malleable metal strip is roughly in the shape of a Z. First end 24 of the strip is attached to the face mask 10 at a point near the top edge of the mask 10; second end 26 of the strip is attached to the transparent member 20 at a point in the lower half 26 of the transparent member 26, as can be seen in FIG. 2. This conformation of the malleable strip and attachment to the mask and transparent member allows the wearer to secure the mask to their face, and then to grasp the transparent member and pull it away from the face to the full extent of the height of the Z. This design will also allow the wearer to collapse the strip of malleable metal and the transparent member back towards their face when so desired. Although this embodiment is shown with the strip of malleable metal oriented vertically, that is in a line with the chin and forehead of a wearer, the strip could also be oriented horizontally, that is in a line with the nose and ears of a wearer. If the strip of malleable metal were oriented horizontally then it could be used to both position the distance between the transparent member and the wearer's face, and to also control the curvature of the transparent member.

The control of curvature of the transparent member would be accomplished by affixing a length 26 of a malleable metal strip adjustment structure 30 to the transparent member 20 from the side edge of the transparent member to a point that is in front of the wearer's face and then fixing the opposite end of the strip 24 to the mask 10, as can be seen in FIG. 3. The length of the metal strip that is affixed to the transparent member can be deformed such that the member is curved to come close to the sides of the face of the wearer. If the size of the transparent member has been chosen such that the transparent member is wide enough to cover the ears of the wearer, then this adjustment structure embodiment can be used to bring the side edges of the mask in close to the ears of the wearer.

An alternative attachment of the adjustment structure, that is not shown, is to use a strip of malleable metal that is longer than the full width of the transparent member, and to attach the central portion of this strip to the mask over the nose portion of the mask, and to attach a length of either end of the strip to the transparent member. The single strip would be oriented horizontally, that is in the line of the nose and ears of the wearer, and could be used to both control the curvature of the transparent member and to adjustably position the transparent member at a plurality of distances from the wearer's face.

The adjustment means can also be made such that the transparent member stands a fixed distance away from the wearer's face, for example by use of compressible foam. This design would allow the face protector to be compacted for shipping, and would provide a spacer between the face mask and transparent member when the face protector is worn. Although this design will improve the comfort of the face protector by moving the transparent member away from the face of the wearer, this design is less desirable as the wearer is not able to draw the transparent member closer to their face when needed.

A separate transparent member curvature bar could be used for the manipulation of the curvature of the transparent member independent of the adjustment structure. Such a curvature bar would be fastened to the transparent member separately from the adjustment structure, thus allowing the wearer to control the overall curvature of the transparent member.

Other Embodiments

As will be apparent to one of ordinary skill in the art, it is possible to make changes, substitutions and alterations in the above-described mask with adjustable shield without departing from the spirit of the invention. Such changes, substitutions and alterations should fall within the scope of the invention as claimed below.

What is claimed is:

1. A face protector, comprising:

a mask for covering a nose and a mouth of a wearer's face, said mask having a fastener to secure said mask to said wearer's face;

a transparent member dimensioned to cover at least a portion of said wearer's face;

an adjustable structure fixing said mask to said transparent member, said adjustable structure comprising two strips of malleable material, each strip comprising a first portion attached to said mask and a second portion attached to said transparent member, said adjustable structure being manipulatable to position said transparent member at a plurality of distances from said covered portion of said wearer's face, manipulation of said adjustable structure resulting in movement of said transparent member relative to said wearer's face and also relative to said secured mask.

2. The face protector of claim 1 wherein said mask is liquid resistant.

3. The face protector of claim 1 wherein said mask includes one or more pleats to provide a comfortable fit of said mask on the mouth of said wearer's face.

4. The face protector of claim 1 wherein said mask has a top edge that is positioned across the nose of said wearer's face, said top edge having a dark colored strip thereon to reduce the reflection of light rays from said mask onto said transparent member.

5. The face protector of claim 1 wherein said transparent member is liquid impervious.

6. The face protector of claim 1 wherein said transparent member is flexible.

7. The face protector of claim 1 wherein said malleable material is articulated cardboard.

8. The face protector of claim 1 wherein said malleable material is articulated plastic.

9. The face protector of claim 1 wherein said adjustable structure is further manipulatable to alter the curvature of said transparent member.

10. The face protector of claim 1 wherein said adjustable structure provides the sole means by which said transparent member is secured in proximity to said wearer's face.

11. The face protector of claim 1 wherein said adjustable structure allows positioning of said transparent member to positions at least about two inches away from said wearer's face.

12. A face protector, comprising:

a mask for covering a nose and mouth of a wearer's face;

a fastener for securing said mask in a substantially fixed position on said wearer's face;

a transparent member dimensioned to cover at least a portion of said wearer's face, said transparent member being adapted for continuous movement among a plurality of positions at variable distances from said wearer's face;

a malleable material affixed to and connecting said mask and said transparent member so that said transparent member may be moved to each of said plurality of positions while said mask remains secured in said substantially fixed position on said wearer's face.

* * * * *